US011428025B2

(12) United States Patent
Chen

(10) Patent No.: US 11,428,025 B2
(45) Date of Patent: Aug. 30, 2022

(54) DOOR LOCK

(71) Applicant: Ti Chen, Taipei (TW)

(72) Inventor: Ti Chen, Taipei (TW)

( * ) Notice: Subject to any disclaimer, the term of this patent is extended or adjusted under 35 U.S.C. 154(b) by 296 days.

(21) Appl. No.: 16/793,033

(22) Filed: Feb. 18, 2020

(65) Prior Publication Data

US 2021/0254366 A1 Aug. 19, 2021

(51) Int. Cl.

| | |
|---|---|
| ***E05B 13/10*** | (2006.01) |
| ***E05B 67/38*** | (2006.01) |
| ***E05B 37/02*** | (2006.01) |
| ***E05B 59/00*** | (2006.01) |
| ***E05B 37/00*** | (2006.01) |

(52) U.S. Cl.

CPC ..... *E05B 13/103* (2013.01); *E05B 13/101* (2013.01); *E05B 37/0058* (2013.01); *E05B 37/02* (2013.01); *E05B 59/00* (2013.01); *E05B 67/383* (2013.01)

(58) Field of Classification Search

CPC ..... E05B 13/10; E05B 13/101; E05B 13/103; E05B 13/105; E05B 37/0048; E05B 37/0058; E05B 37/02; E05B 59/00; E05B 67/383

See application file for complete search history.

(56) References Cited

U.S. PATENT DOCUMENTS

| | | | | |
|---|---|---|---|---|
| 1,594,960 | A * | 8/1926 | Hugues | E05B 37/02 70/312 |
| 1,898,947 | A * | 2/1933 | Frey | E05B 13/103 70/213 |
| 3,018,651 | A * | 1/1962 | Morrison, Jr. | E05B 59/00 70/476 |
| 3,521,471 | A * | 7/1970 | Aretola | E05B 37/02 70/213 |
| 4,881,390 | A * | 11/1989 | Vale | E05B 37/02 70/213 |
| 6,497,126 | B2 * | 12/2002 | Wang | E05B 13/101 70/472 |
| 8,250,888 | B2 * | 8/2012 | Agazzi | E05B 13/103 70/213 |
| 8,256,253 | B2 * | 9/2012 | Chen | E05B 13/101 70/222 |
| 2019/0169877 | A1 * | 6/2019 | Fishkin | E05B 37/02 |

* cited by examiner

*Primary Examiner* — Christopher J Boswell

(74) *Attorney, Agent, or Firm* — Alan D. Kamrath; Karin L. Williams; Mayer & Williams PC

(57) ABSTRACT

A door lock has an inner door assembly, an indoor doorknob assembly, and an outdoor doorknob assembly. The inner door assembly has a locking assembly casing. The indoor doorknob assembly has a positioning resilient component located in the locking assembly casing and configured to switch the door lock between a locked state and an unlocked state. The door is provided with enhanced protection by enclosing the positioning resilient component in the locking assembly casing, so the safety is further improved.

5 Claims, 10 Drawing Sheets

DOOR LOCK

BACKGROUND OF THE INVENTION

1. Field of the Invention

The present invention relates to a lock assembly, especially to a door assembly that is adapted to be mounted on the door and has higher security.

2. Description of the Prior Arts

Conventionally, door locks are unlocked by a corresponding key. In other words, people without the key will not have access into the door. Normally, a volume of the conventional key is small so sometimes people may lose the key or forget to bring the key. To solve the problems arising from neglect of the key, electric password locks are invented. The electric password lock comprises a power supply, which may be a battery box or may be connected to a socket. If the battery runs out of power or if there is power failure, the electric password lock may not work and thus no one can open the door.

Therefore, the trends of door locks go back to mechanical combination locks. Currently, the mechanical combination lock is mounted in a mounting space of the door, and the mechanical combination lock has a positioning resilient component exposed in the mounting space. The positioning resilient component is configured to switch the mechanical combination door lock between a locked state and an unlocked state. As the door is mostly structurally weaker than the mechanical combination lock, an intruder may attempt to drill a hole on the door, which is easier than drilling a hole in the mechanical combination lock. Therefore, even though the entire mechanical combination lock seals the mounting space, the intruder still can reach the mounting space of the door by drilling the door and then manipulate the positioning resilient component to unlock. In other words, the current mechanical combination lock is still unsafe. This problem exists in every type of door locks.

Besides, when a user unlocks the current mechanical combination door lock, the unlocking code/password may be left displayed on the mechanical combination door lock, so the user has to rotate the code rings or press the password buttons. If the user forgets to disarray the code rings or the password buttons, anyone can unlock the mechanical combination door lock arbitrarily, which also makes the current mechanical combination lock unsafe.

To overcome the shortcomings, the present invention provides a mechanical combination door lock to mitigate or obviate the aforementioned problems.

SUMMARY OF THE INVENTION

The main objective of the present invention is to provide a door lock that has improved security.

The door lock has an inner door assembly, an indoor doorknob assembly, and an outdoor doorknob assembly. The inner door assembly is mounted inside the door, configured to lock the door, and comprises a locking assembly casing mounted inside the door. The indoor doorknob assembly is connected to the inner door assembly and comprises an indoor handle, a protecting tube, a positioning resilient component, a controlling component, and a reset resilient component. The indoor handle is pivotally mounted on the door. The protecting tube extends into the locking assembly casing and is connected to the indoor handle, and thereby the protecting tube is capable of rotating along with the indoor handle. The positioning resilient component is mounted on the protecting tube, located in the locking assembly casing, and configured to switch the door lock between a locked state and an unlocked state. The controlling component is movably mounted in the indoor handle. The controlling component comprises a pressed end, a controlling end, and a recess. The pressed end extends out of the indoor handle and away from the door. The controlling end is opposite the pressed end, and extends out of the indoor handle and into the locking assembly casing of the inner door assembly. The recess is located in the locking assembly casing and selectively receives the positioning resilient component. The reset resilient component is connected to the controlling component and configured to drive the controlling component to protrude out of the indoor handle. The outdoor doorknob assembly is connected to the inner door assembly. The indoor doorknob assembly and the outdoor doorknob assembly are located on two opposite sides of the door respectively. When the controlling component is pressed into the indoor handle, the door lock is in the locked state and the positioning resilient component is received in the recess of the controlling end. Then, when the indoor handle is pivoted, the positioning resilient component departs from the recess and the reset resilient component drives the controlling component to move out of the indoor handle, thereby driving the door lock back to the unlocked state.

Because the positioning resilient component is located in the locking assembly casing, an intruder has to at least break the door and the mechanical combination lock to reach the positioning resilient component, and then use the positioning resilient component to switch to the unlocked state. Thus, the present invention protects the positioning resilient component by receiving it in the locking assembly casing, so the security is improved. Besides, when the positioning resilient component is located in the locking assembly casing, the capacity of shake endurance is improved, so the locking assembly casing will not be switched the lock mechanism even when the door is stricken.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
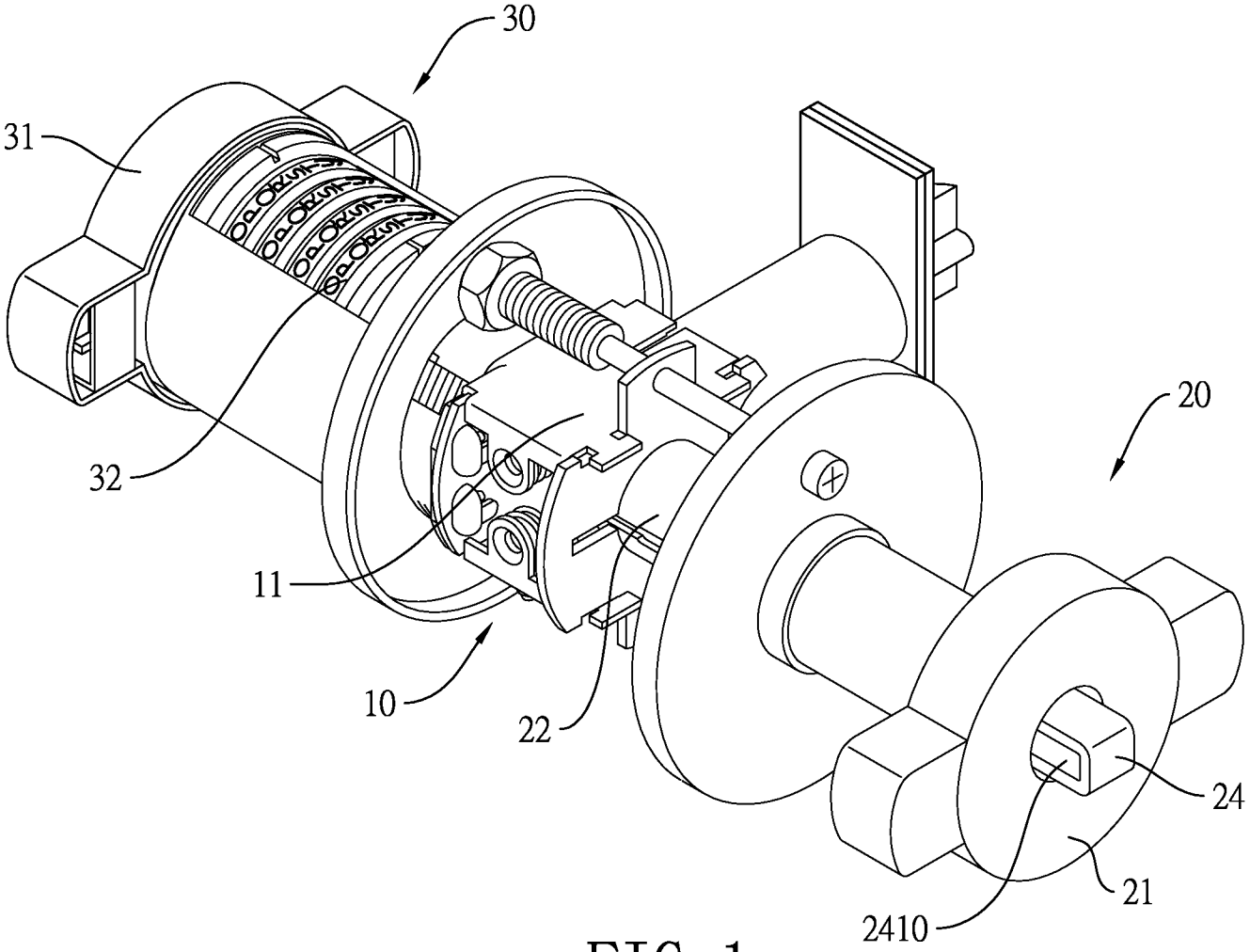
FIG. 1 is a perspective view of a door lock in accordance with the present invention.
Figure 2:
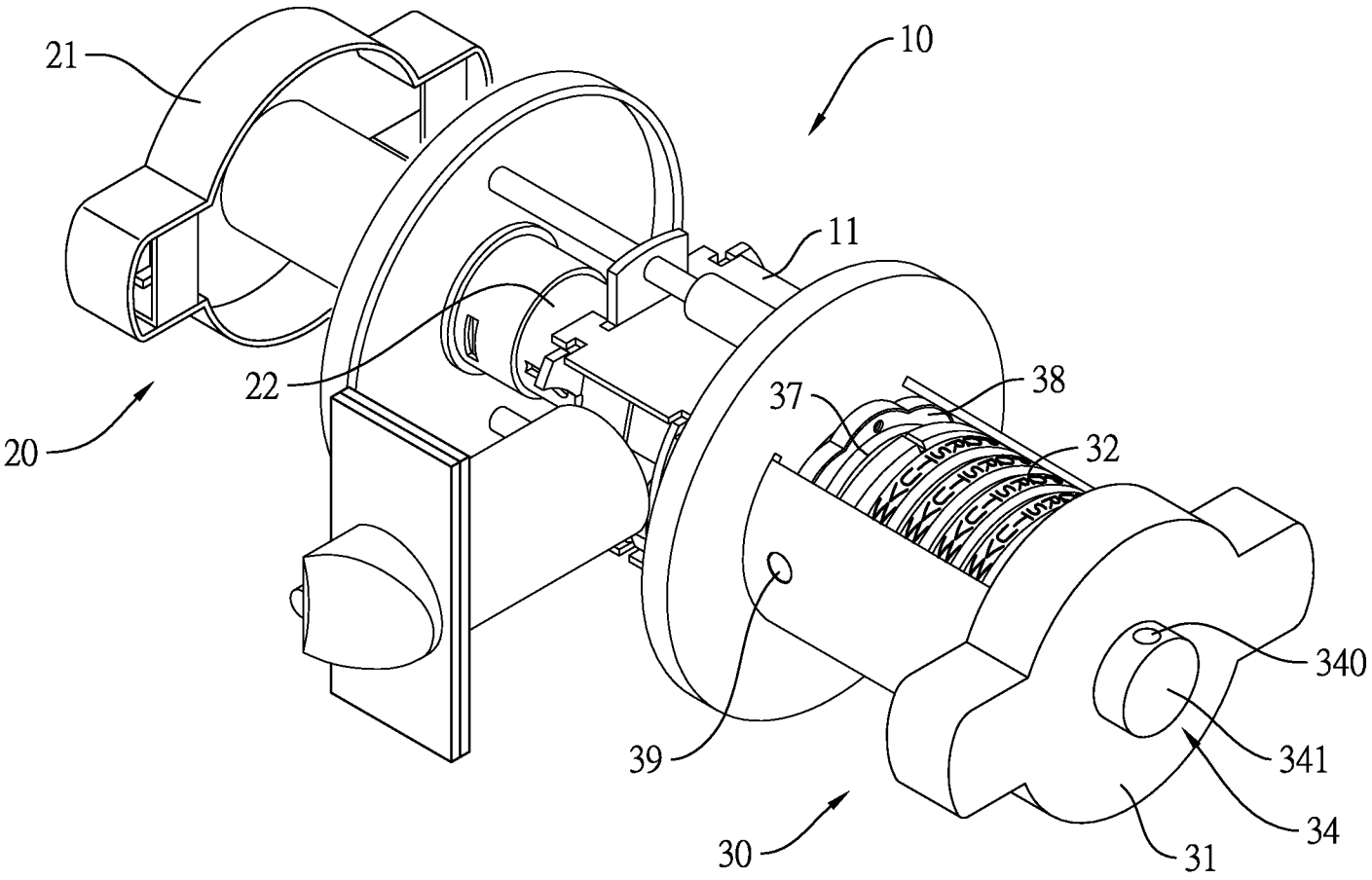
FIG. 2 is another perspective view of the door lock in FIG. 1.

Please refer to FIG. 1 and FIG. 2. A door lock in accordance with the present invention is provided and configured to be mounted on a door for locking the door. The door may comprise a first surface and a second surface opposite each other, and a mounting space formed through the door.

The door lock comprises an inner door assembly 10, an indoor doorknob assembly 20, and an outdoor doorknob assembly 30. If the outdoor doorknob assembly 30 comprises code rings or password buttons, the present door lock is a mechanical combination door lock, but it is not limited thereto. In other words, technical features of the indoor doorknob assembly 20 can be utilized to other types of door locks, e.g. a door lock which can be unlocked by a key. Hereinafter, the embodiment is elaborated as a mechanical combination door lock.

Then please refer to FIG. 3 to FIG. 6. The inner door assembly 10 is mounted in the mounting space of the door, configured to lock the door, and comprises a locking assembly casing 11. The locking assembly casing 11 is mounted in the mounting space and is connected with the indoor doorknob assembly 20 and the outdoor doorknob assembly 30. In other words, the locking assembly casing 11 is between the indoor doorknob assembly 20 and the outdoor doorknob assembly 30.

The indoor doorknob assembly 20 is mounted on the first surface of the door, seals the mounting space at one end thereof, and comprises an indoor handle 21, a protecting tube 22, a positioning resilient component 23, a controlling component 24, and a reset resilient component 25. The indoor handle 21 is pivotally mounted on the first surface of the door. The protecting tube 22 is connected to the indoor handle 21 and thereby, when the indoor handle 21 is pivoted, the protecting tube 22 is also pivoted along with the indoor handle 21. The protecting tube 22 extends into the locking assembly casing 11. The positioning resilient component 23 is configured to switch the mechanical combination door lock between a locked state and an unlocked state. The positioning resilient component 23 is mounted on the protecting tube 22 and located in the locking assembly casing 11. Therefore, as the indoor handle 21 is pivoted, the positioning resilient component 23 is moved about an axis of the indoor handle 21.

The controlling component 24 is movably mounted in the indoor handle 21 and comprises a pressed end 241, a controlling end 242, an inclined edge 2421, and a recess 2422. The pressed end 241 is one end of the controlling component 24 that is away from the first surface of the door and extends out of the indoor handle 21. The controlling end 242 is one end of the controlling component 24 that is opposite the pressed end 241. The controlling end 242 extends out of the indoor handle 21 and into the locking assembly casing 11 of the inner door assembly 10. The inclined edge 2421 is formed on the controlling end 242 and selectively abuts the positioning resilient component 23. The inclined edge 2421 is oblique to a moving direction of the controlling component 24. Thus, when the controlling component 24 is moved, the inclined edge 2421 can push the positioning resilient component 23 away. The recess 2422 is formed near the controlling end 242 and is closer to the positioning resilient component 23 than the inclined edge 2421. The recess 2422 is capable of receiving the positioning resilient component 23. In this embodiment, the positioning resilient component 23 is a spring, but it is not limited thereto. The reset resilient component 25 is connected to the controlling component 24 and is configured to drive the controlling component 24 to move away from the outdoor doorknob assembly 30 and out of the indoor handle 21.

Figure 3:
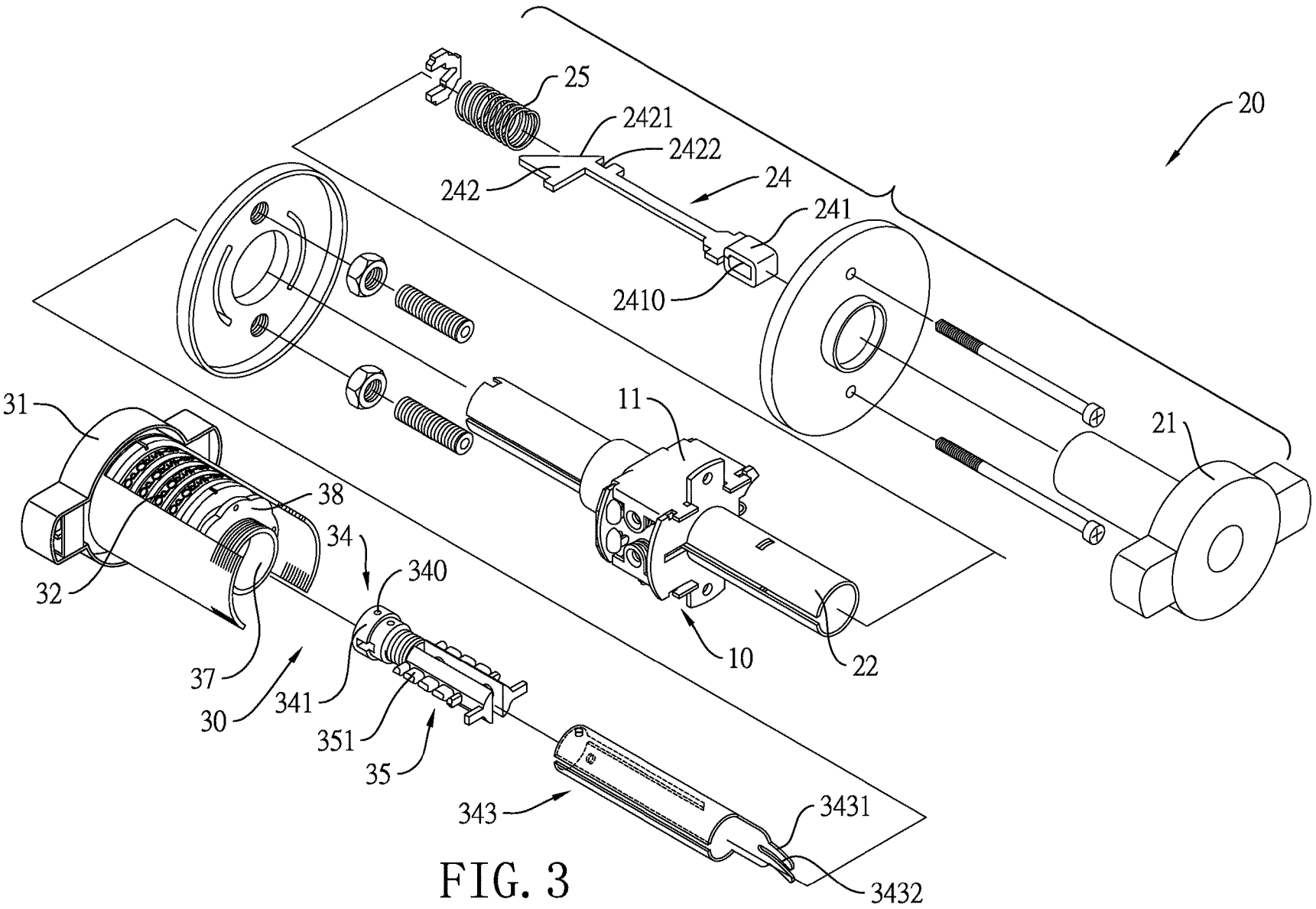
FIG. 3 is an exploded perspective view of the door lock in FIG. 1.
Figure 7:
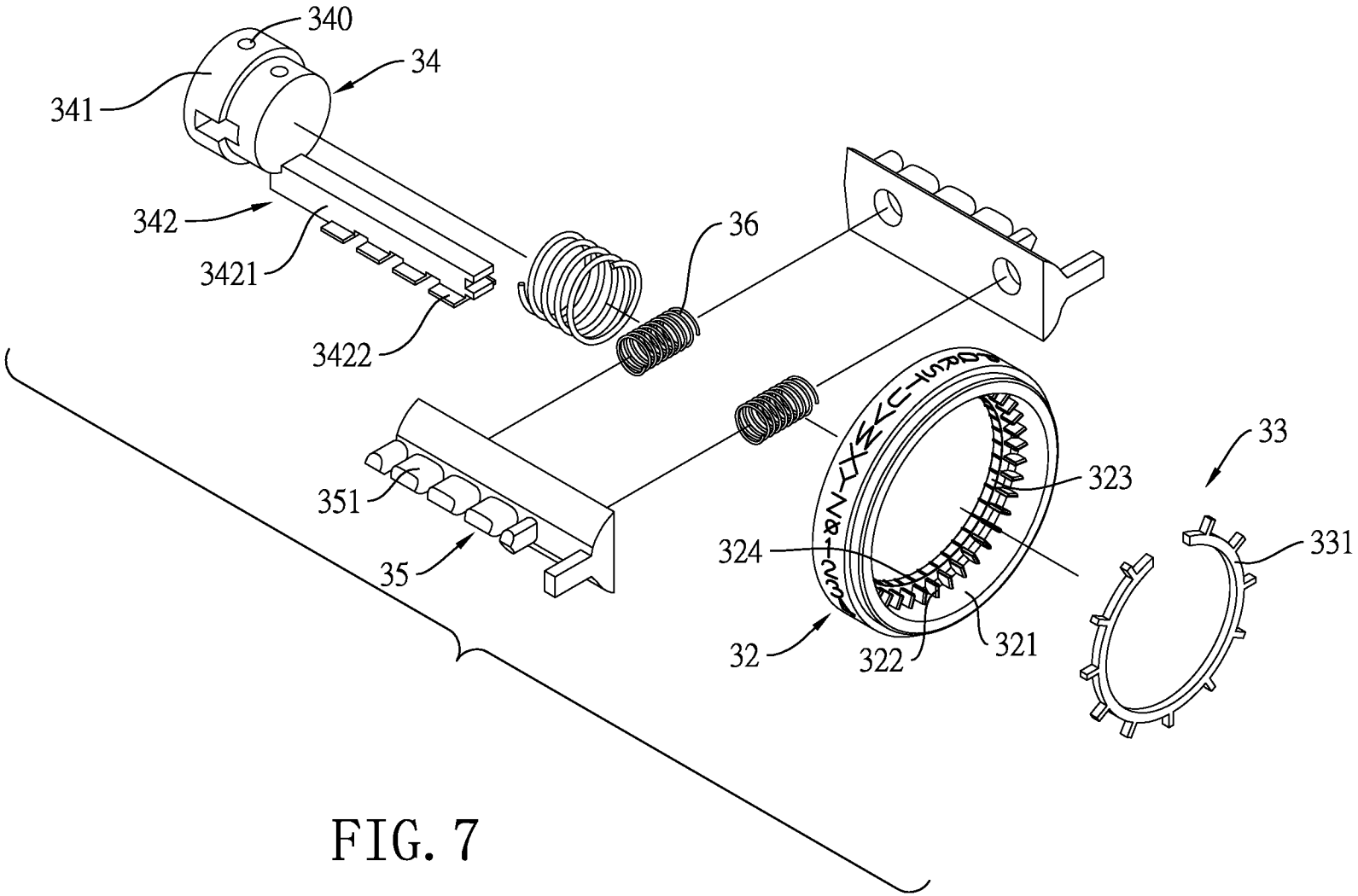
FIG. 7 is an exploded perspective view of a part of an outdoor doorknob assembly of the door lock in FIG. 1.

Then please refer to FIG. 3 and FIG. 7. The outdoor doorknob assembly 30 is mounted on the second surface of the door, seals the mounting space at another end thereof, and comprises an outdoor handle 31, a plurality of code rings 32, a plurality of inner rings 33, a pressed component 34, two engaging components 35, two engaging resilient components 36, a screw seat 37, and a rotatable ring 38.

Figure 8:
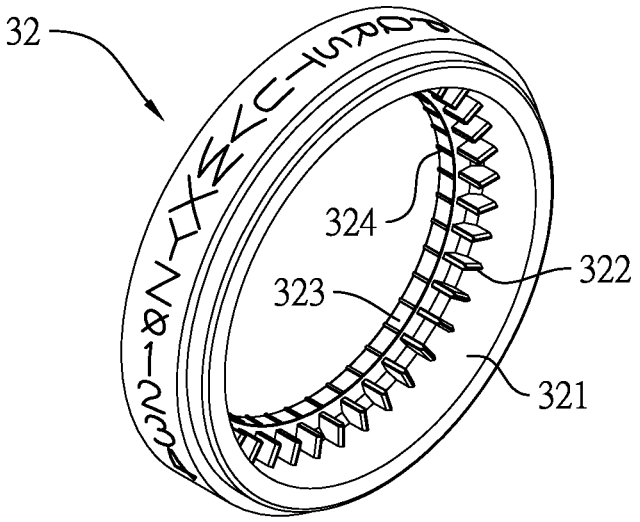
FIG. 8 is a perspective view of a code ring of the door lock in FIG. 1.
Figure 9:
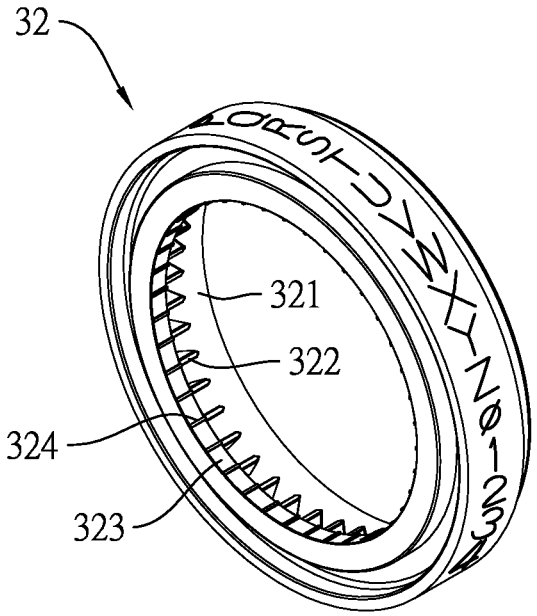
FIG. 9 is another perspective view of the code ring of the door lock in FIG. 1.

Please also refer to FIG. 8 and FIG. 9. The outdoor handle 31 is pivotally mounted on the second surface of the door. The code rings 32 are pivotally mounted in the outdoor handle 31. Each one of the code rings 32 comprises a first inner peripheral surface 321 and a second inner peripheral surface 323 adjacent to the first inner peripheral surface 321. In this embodiment, a diameter of the second inner peripheral surface 323 is smaller than that of the first inner peripheral surface 321. Each one of the code rings 32 further comprises a plurality of first teeth 322 and a plurality of second teeth 324. The first teeth 322 are formed on the first inner peripheral surface 321 and the second teeth 324 are formed on the second inner peripheral surface 323. In another embodiment, the diameters of the first inner peripheral surface 321 and the second inner peripheral surface 323 may be equal in length, but a depth of each second tooth 324 is smaller than that of each first tooth 322.

A plurality of symbols are formed on an outer peripheral surface of each code ring 32. In this embodiment, the symbols are Arabic numerals and English alphabets, so there are thirty six symbols formed on each code ring 32, but it is not limited thereto. Both an amount of the second teeth 324 and an amount of the first teeth 322 are equal to the amount of the symbols.

The inner rings 33 are respectively mounted in the code rings 32. Precisely, each one of the inner rings 33 comprises a plurality of outer teeth 331 on an outer peripheral surface of the inner ring 33. The outer teeth 331 are selectively engaged with the first teeth 322 of the corresponding code ring 32. When the outer teeth 331 are engaged with the first teeth 322, the code ring 32 can drive the corresponding inner ring 33 to rotate for the same degrees as the code ring 32 is rotated. When the outer teeth 331 are disengaged from the first teeth 322, the code ring 32 can be rotated freely with respect to the inner ring 33. Each one of the inner rings 33 forms an interval thereon. In other words, each one of the inner rings 33 is C-shaped. Please refer to FIG. 3 and FIG. 7 again. The pressed component 34 is movably mounted in the outdoor handle 31 and connected to the inner door assembly 10. The pressed component 34 comprises a button piece 341, an extending piece 342, and a pushing piece 343. The extending piece 342 comprises a stick 3421 and a plurality of pairs of tabs 3422. One end of the stick 3421 is mounted on the button piece 341 and the stick 3421 extends toward the indoor doorknob assembly 20 from the button piece 341. Each pair of the tabs 3422 is mounted on the stick 3421. The pairs of the tabs 3422 are spaced apart from each other along an extending direction of the stick 3421. The tabs 3422 in each pair are mounted on two opposite surfaces of the stick 3421. An amount of the pairs of the tabs 3422 is equal to an amount of the inner rings 33. With the tabs 3422, a strength of the extending piece 342 is enhanced so that when an intruder want to break the outdoor doorknob assembly 30, the extending piece 342 can resist more impacts.

The pushing piece 343 is connected to the button piece 341, so when a user pushes the button piece 341, the pushing piece 343 will be moved with the button piece 341. The pushing piece 343 is mounted in the outdoor handle 31 but one end of the pushing piece 343 is extend out of the outdoor handle 31 and into the locking assembly casing 11. Precisely, the pushing piece 343 comprises a pushing end located in the locking assembly casing 11. The pushing end forms at least one inclined portion 3431. The at least one inclined portion 3431 is configured to push the positioning resilient component 23 away. In this embodiment, the pushing end has two inclined portions 3431 and the two inclined portions 3431 space a part form each other.

In other words, a gap 3432 is formed between the two inclined portions 3431. The gap 3432 is capable of receiving the controlling component 24. In other words, the controlling component 24 is located between the two inclined portions 3431 and thus when the inclined portions 3431 push the positioning resilient component 23 away, the positioning resilient component 23 will not hinder the controlling component 24 from moving.

The engaging components 35 are movably mounted in the outdoor handle 31. The two engaging components 35 are spaced apart from and parallel to each other. The two engaging resilient components 36 are spaced apart from and parallel to each other, too, and two ends of each engaging resilient component 36 are respectively connected to the engaging components 35. Therefore, the engaging resilient components 36 are configured to drive the engaging components 35 to move away from each other. In other words, the engaging resilient components 36 are configured to drive to move to non-tightly abut the second inner peripheral surface 323 of the code rings 32.

Figure 10:
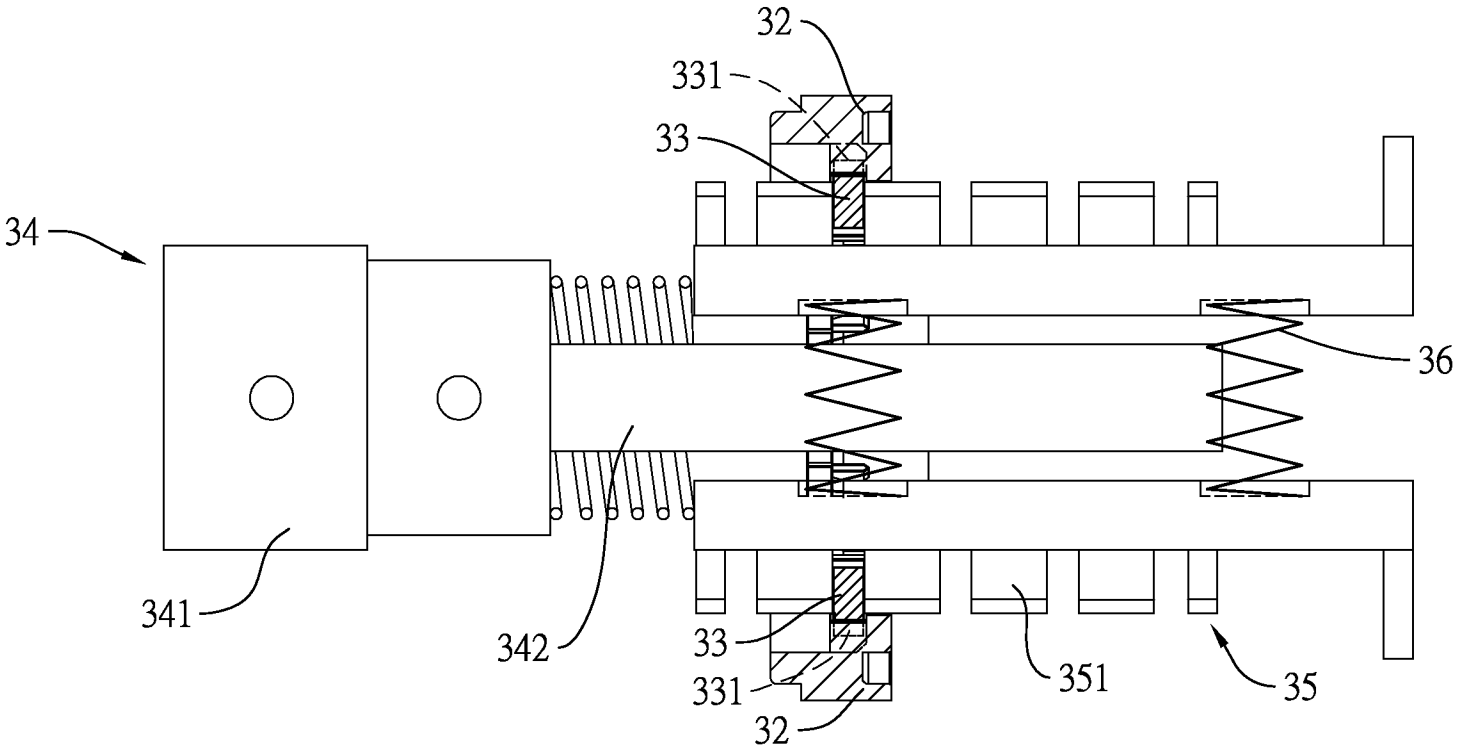
FIGS. 10 and 11 are serial operational views of a pressed component and engaging components of the outdoor doorknob assembly in FIG. 6.
Figure 11:
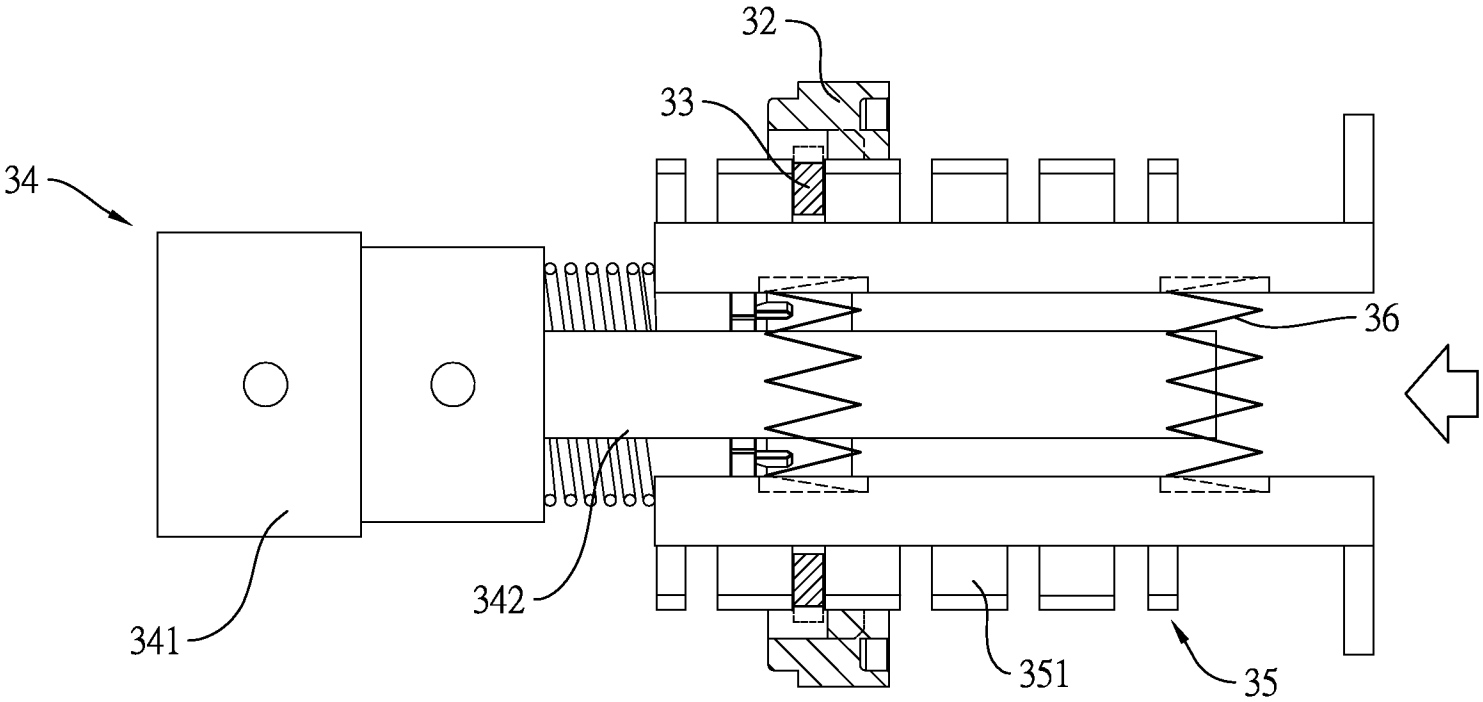

Please also refer to FIG. 10 and FIG. 11. Each one of the engaging components 35 comprises a plurality of engaging tabs 351. Each one of the engaging tabs 351 of one of the engaging components 35 extends away from the other engaging component 35. The second teeth 324 of each one of the code rings 32 are selectively slidably engaged with one of the engaging tabs 351. Each one of the inner rings 33 is pivotally clamped in a gap formed between two adjacent ones of the engaging tabs 351. Therefore, when the engaging components 35 are moved, the engaging components 35 can drive the inner rings 33 to move by the same distance and thus the inner rings 33 are disengaged from the code rings 32.

In another embodiment, even if the mechanical combination lock may only comprise one engaging component, the mechanical combination lock still can carry out the above functions. For the same reason, the combination lock may only comprise one engaging resilient component.

The screw seat 37 is fixed with respect to the door. In other words, the screw seat 37 will not be rotated when the outdoor handle 31 is rotated. The rotatable ring 38 is pivotally sleeved on the screw seat 37 and connected to the engaging component 35. Therefore, when rotated with respect to the screw seat 37, the rotatable ring 38 will move at the same time, and thus the rotatable ring 38 drives the engaging components 35 and the inner rings 33 to move along with the rotatable ring 38.

As a result, the indoor user presses the controlling component 24 into the indoor handle 21 to lock the door, or rotates the indoor handle 21 to unlock the door. Precisely, when pressed by the user, the controlling component 24 is moved toward the outdoor doorknob assembly 30, and the inclined edge 2421 presses away the positioning resilient component 23, which switches the mechanical combination door lock into the locked state. When the positioning resilient component 23 is received in the recess 2422 of the controlling end 242 of the controlling component 24, the movement of pressing the controlling component 24 is completed and thus the mechanical combination door lock remains in a locked state.

Figure 4:
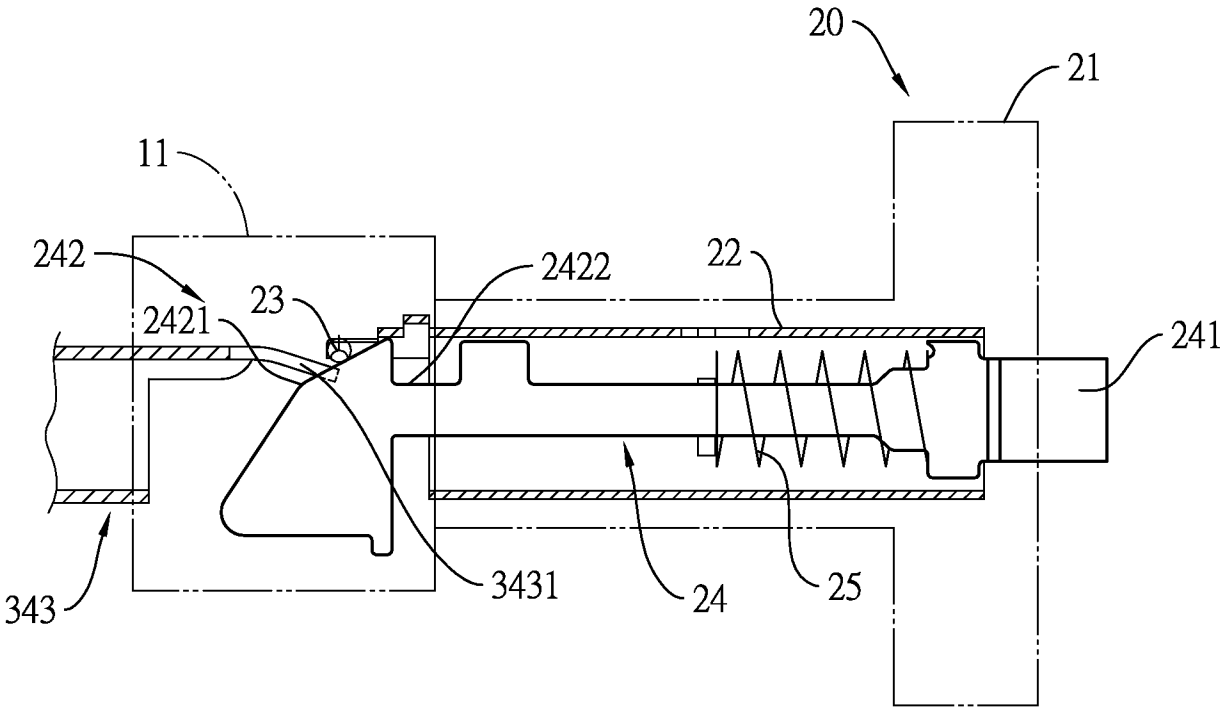
FIGS. 4 to 6 are serial operational views of an indoor doorknob assembly of the door lock in FIG. 1.
Figure 5:
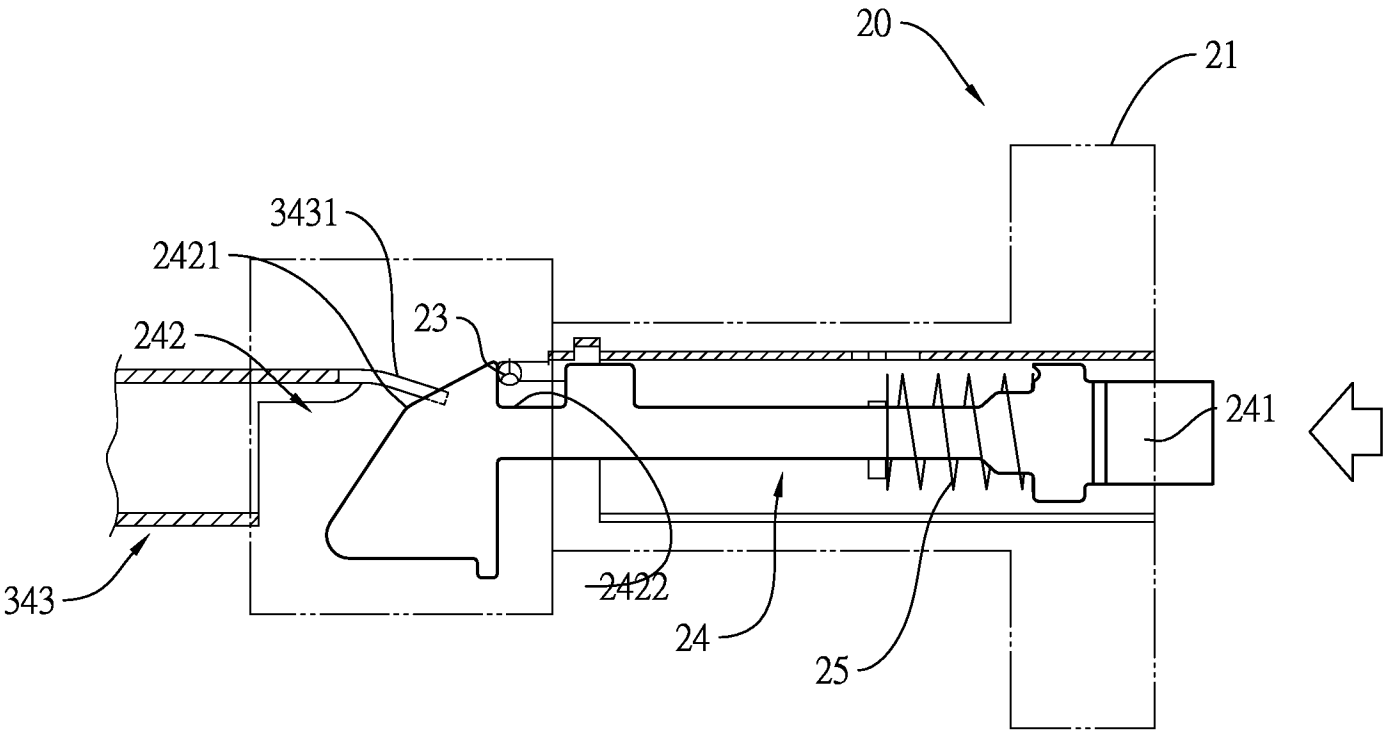
Figure 6:
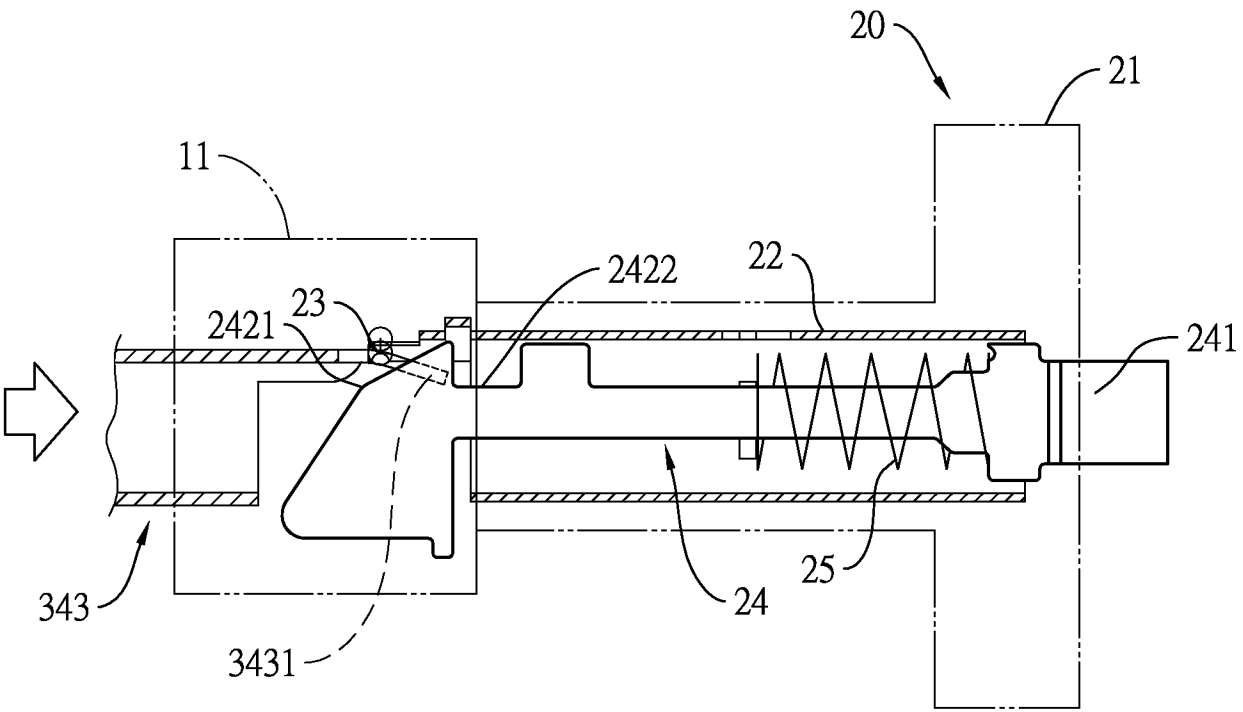

Please refer to FIG. 4 to FIG. 6 again. Because the positioning resilient component 23 is located in the locking assembly casing 11, an intruder has to at least break the whole mechanical combination door to reach the positioning resilient component 23, and then use the positioning resilient component 23 to switch to the unlocked state. Normally, drilling a hole on a door to reach the mounting space of the door is much easier than drilling a hole on a lock to reach the mounting space. Thus, the present invention protects the positioning resilient component 23 by receiving it in the locking assembly casing 11, so the intruder cannot avoid to drill the mechanical combination door and thus security is improved. Besides, as the positioning resilient component 23 is located in the locking assembly casing 11, the capacity of shake endurance is improved, so the locking assembly casing 11 will not switch the lock mechanism even when the door is stricken.

Then, when the indoor user rotates the indoor handle 21, the positioning resilient component 23 departs from the recess 2422, so the positioning resilient component 23 does not restrict the controlling component 24, and thus the reset resilient component 25 can drive the controlling component 24 to move away from the exterior of the outdoor doorknob assembly 30 and to protrude out of the indoor handle 21. At the same time, the mechanical combination door lock is switched back to the unlocked state.

Please refer to FIG. 3 and FIG. 7 to FIG. 11. When the mechanical combination door lock is in the locked state, as each one of the code rings 32 and the corresponding inner ring 33 are rolled to a corresponding correct position, the user can exert a force and move the pressed component 34 into the outdoor handle 31 and thus switch the mechanical combination door lock to the unlocked state. Precisely, the user pressing the pressed component 34 means the user pressing the button piece 341, and thus the pushing piece 343 is driven to push the positioning resilient component 23. Then, the controlling component 24 is moved away from the outdoor doorknob assembly 30, and thus the mechanical combination door lock is in the unlocked state. Then, if the user no longer exerts the force on the pressed component 34, a resilient component pushes the pressed component 34 back to protrude out of the outdoor handle 31.

Because the engaging resilient components 36 drive the engaging component 35 to only non-tightly abut the code rings, the second teeth 324 of the code rings 32 selectively slidably engage with the corresponding engaging tab 351. When the outdoor handle 31 is rotated and the engaging component 35 is rotated along with the outdoor handle 31, the code rings 32 are rotated by the corresponding engaging tab 351 for random degrees. Especially, the rotating speed of the outdoor handle 31 is higher, the random result is more significant. For example, after the user rotates the outdoor handle 31 and then exerts no force on the outdoor handle 31, the outdoor handle 31 can rotate back spontaneously, and the speed of the rotating back may be high enough to randomly rotate the code rings 32.

Besides, the rotatable ring 38 can drive the engaging component 35 and the inner rings 33 to move toward the button piece 341, and thus the outer teeth 331 of each one of the inner rings 33 disengage from the first teeth 322 of the corresponding code ring 32 and the second teeth 324 of each one of the code rings 32 disengage from the corresponding engaging tab 351, thereby the code rings 32 are capable of freely rotating with respect to the inner rings 33 and the engaging tabs 351 so that the user can change the unlocking codes/passwords.

Then please refer to FIG. 1 and FIG. 2. In this embodiment, the mechanical combination door lock selectively comprises a first fixing hole 39, a second fixing hole 340, and a third fixing hole 2410 configured to receive a latch or a padlock mounted therein.

The first fixing hole 39 is formed adjacent to the rotatable ring 38, and precisely, the first fixing hole 39 is located aside the path of the rotatable ring 38. Therefore, when a latch or a padlock is mounted in the first fixing hole 39, the rotatable ring 38 cannot be moved and thereby the engaging component 35 also cannot be moved, so the unlocking codes/passwords cannot be changed by moving the rotatable ring 38.

The second fixing hole 340 is formed at an end, which away from the inner door assembly 10, of the pressed component 34. Therefore, when a latch or a padlock is mounted in the second fixing hole 340, the pressed component 34 cannot be pressed into the outdoor handle 31. In other words, even though the code rings 32 are rotated to the correct position, the mechanical combination door cannot be switched to the unlocked state by pressing the pressed component 34.

The third fixing hole 2410 is formed at the pressed end 241 of the controlling component 24. Therefore, when a latch or a padlock is mounted in the third fixing hole 2410, the controlling component 24 cannot be pressed into the indoor handle 21.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A door lock adapted to be mounted on a door, the door lock comprising:

an inner door assembly mounted inside the door, configured to lock the door, and comprising:

a locking assembly casing mounted inside the door; and an indoor doorknob assembly connected to the inner door assembly and comprising:

an indoor handle pivotally mounted on the door;

a protecting tube extending into the locking assembly casing and connected to the indoor handle, thereby capable of rotating along with the indoor handle;

a positioning resilient component mounted on the protecting tube, located in the locking assembly casing, and configured to switch the door lock between a locked state and an unlocked state;

a controlling component movably mounted in the indoor handle and comprising:

a pressed end extending out of the indoor handle and away from the door;

a controlling end opposite the pressed end, and extending out of the indoor handle and into the locking assembly casing of the inner door assembly; and a recess located in the locking assembly casing and selectively receiving the positioning resilient component;

a reset resilient component connected to the controlling component and configured to drive the controlling component to protrude out of the indoor handle;

an outdoor doorknob assembly connected to the inner door assembly; the indoor doorknob assembly and the outdoor doorknob assembly located on two opposite sides of the door respectively;

wherein when the controlling component is pressed into the indoor handle, the door lock is in the locked state and the positioning resilient component is received in the recess of the controlling end; then, when the indoor handle is pivoted, the positioning resilient component departs from the recess and the reset resilient component drives the controlling component to move out of the indoor handle, thereby driving the door lock back to the unlocked state; wherein:

the outdoor doorknob assembly comprises:

an outdoor handle pivotally mounted on the door;

a plurality of code rings pivotally mounted in the outdoor handle; and a pressed component movably mounted in the outdoor handle and connected to the inner door assembly;

wherein in the locked state of the door lock, when each one of the code rings is dialed to a respective correct position, the pressed component is capable of being moved into the outdoor handle and thus driving the door lock to switch to the unlocked state;

each one of the code rings comprises:

a first inner peripheral surface;

a second inner peripheral surface; a diameter of the second inner peripheral surface smaller than a diameter of the first inner peripheral surface;

a plurality of first teeth formed on the first inner peripheral surface; and a plurality of second teeth formed on the second inner peripheral surface; an amount of the second teeth being equal to an amount of the first teeth;

the outdoor doorknob assembly further comprises:

an engaging component movably mounted in the outdoor handle and comprising:

a plurality of engaging tabs; the second teeth of each one of the code rings selectively slidably engaging with one of the engaging tabs;

an engaging resilient component connected to the engaging component and configured to move the engaging component to selectively slidably engage with the code rings;

a plurality of inner rings respectively mounted in the code rings; each one of the inner rings pivotally clamped between two adjacent ones of the engaging tabs and comprising:

a plurality of outer teeth formed on an outer peripheral surface of the inner ring and selectively engaging with the first teeth of the corresponding code ring;

wherein when the second teeth of the code rings selectively slidably engage with the corresponding engaging tab, as the outdoor handle is pivoted and the code rings and the inner rings are rotated along with the outdoor handle, the code rings are rotated by the corresponding engaging tab for random degrees;

the outdoor doorknob assembly further comprises:

a screw seat fixed with respect to the door;

a rotatable ring pivotally sleeved on the screw seat and connected to the engaging component; and a first fixing hole formed adjacent to the rotatable ring and configured to receive a latch or a padlock mounted therein; wherein when the latch or the padlock is mounted in the first fixing hole, the rotatable ring is unmovable and thereby the engaging component is also unmovable;

wherein when the rotatable ring is rotated with respect to the screw seat and thereby moved, the engaging component and the inner rings are moved along with the rotatable ring, so that the outer teeth of each one of the inner rings disengage from the first teeth of the corresponding code ring and the second teeth of each one of the code rings disengage from the corresponding engaging tab, and thereby the code rings capable of being freely rotated with the inner rings and the engaging tabs.

2. The door lock as claimed in claim 1, wherein the controlling component comprises:

a second fixing hole formed at an end, which is away from the inner door assembly, of the pressed component and configured to receive another latch or another padlock mounted therein; wherein when said another latch or said another padlock is mounted in the second fixing hole, the pressed component is unable to be pressed into the outdoor handle.

3. The door lock as claimed in claim 2, wherein the controlling component comprises:

a third fixing hole formed at the pressed end and configured to receive still another latch or still another padlock mounted therein; wherein when said still another latch or said still another padlock is mounted in the third fixing hole, the controlling component is unable to be pressed into the indoor handle.

4. A door lock adapted to be mounted on a door, the door lock comprising:

an inner door assembly mounted inside the door, configured to lock the door, and comprising:

a locking assembly casing mounted inside the door; and an indoor doorknob assembly connected to the inner door assembly and comprising:

an indoor handle pivotally mounted on the door;

a protecting tube extending into the locking assembly casing and connected to the indoor handle, thereby capable of rotating along with the indoor handle;

a positioning resilient component mounted on the protecting tube, located in the locking assembly casing, and configured to switch the door lock between a locked state and an unlocked state;

a controlling component movably mounted in the indoor handle and comprising:

a pressed end extending out of the indoor handle and away from the door;

a controlling end opposite the pressed end, and extending out of the indoor handle and into the locking assembly casing of the inner door assembly; and a recess located in the locking assembly casing and selectively receiving the positioning resilient component;

a reset resilient component connected to the controlling component and configured to drive the controlling component to protrude out of the indoor handle;

an outdoor doorknob assembly connected to the inner door assembly;

the indoor doorknob assembly and the outdoor doorknob assembly located on two opposite sides of the door respectively; the outdoor doorknob assembly comprising:

an outdoor handle pivotally mounted on the door;

a plurality of code rings pivotally mounted in the outdoor handle; and a pressed component movably mounted in the outdoor handle and connected to the inner door assembly; the pressed component comprising:

a fixing hole formed at an end, which is away from the inner door assembly, of the pressed component and configured to receive a latch or a padlock mounted therein;

wherein when the controlling component is pressed into the indoor handle, the door lock is in the locked state and the positioning resilient component is received in the recess of the controlling end; then, when the indoor handle is pivoted, the positioning resilient component departs from the recess and the reset resilient component drives the controlling component to move out of the indoor handle, thereby driving the door lock back to the unlocked state;

wherein in the locked state of the door lock, when each one of the code rings is dialed to a respective correct position, the pressed component is capable of being moved into the outdoor handle and thus driving the door lock to switch to the unlocked state; when the latch or the padlock is mounted in the fixing hole, the pressed component is unable to be pressed into the outdoor handle.

5. A door lock adapted to be mounted on a door, the door lock comprising:

an inner door assembly mounted inside the door, configured to lock the door, and comprising:

a locking assembly casing mounted inside the door; and an indoor doorknob assembly connected to the inner door assembly and comprising:

an indoor handle pivotally mounted on the door;

a protecting tube extending into the locking assembly casing and connected to the indoor handle, thereby capable of rotating along with the indoor handle;

a positioning resilient component mounted on the protecting tube, located in the locking assembly casing, and configured to switch the door lock between a locked state and an unlocked state;

a controlling component movably mounted in the indoor handle and comprising:

a pressed end extending out of the indoor handle and away from the door;

a controlling end opposite the pressed end, and extending out of the indoor handle and into the locking assembly casing of the inner door assembly; and a recess located in the locking assembly casing and selectively receiving the positioning resilient component; and a fixing hole formed at the pressed end and configured to receive a latch or a padlock mounted therein; wherein when the latch or the padlock is mounted in the fixing hole, the controlling component is unable to be pressed into the indoor handle;

a reset resilient component connected to the controlling component and configured to drive the controlling component to protrude out of the indoor handle;

an outdoor doorknob assembly connected to the inner door assembly; the indoor doorknob assembly and the outdoor doorknob assembly located on two opposite sides of the door respectively;

wherein when the controlling component is pressed into the indoor handle, the door lock is in the locked state and the positioning resilient component is received in the recess of the controlling end; then, when the indoor handle is pivoted, the positioning resilient component departs from the recess and the reset resilient component drives the controlling component to move out of the indoor handle, thereby driving the door lock back to the unlocked state.

* * * * *